United States Patent [19]

Shiflett et al.

[11] 4,120,555

[45] Oct. 17, 1978

[54] CONNECTOR-TERMINAL ASSEMBLY FOR ELECTRICAL CONDUCTORS

[75] Inventors: Ned H. Shiflett, Charden; William J. Seybert, Cincinnati, both of Ohio

[73] Assignee: Eltra Corporation, New York, N.Y.

[21] Appl. No.: 784,567

[22] Filed: Apr. 4, 1977

[51] Int. Cl.[2] ..... H01B 17/26; H01R 7/12

[52] U.S. Cl. ..... 339/126 R; 174/152 R; 339/272 R

[58] Field of Search ..... 339/126 R, 272 R; 174/151, 152 R, 153 R, 152 GM

[56] References Cited

U.S. PATENT DOCUMENTS

| | | | |
|---|---|---|---|
| 1,673,946 | 6/1928 | Marr | 339/272 R |
| 2,125,060 | 7/1938 | Barnes et al. | 339/272 R |
| 3,315,215 | 4/1967 | Kulka | 339/126 R |
| 3,793,613 | 2/1974 | Reichert | 339/126 R |

FOREIGN PATENT DOCUMENTS

| | | | |
|---|---|---|---|
| 667,229 | 2/1952 | United Kingdom | 174/53 R |

*Primary Examiner*—Roy Lake
*Assistant Examiner*—E. F. Desmond
*Attorney, Agent, or Firm*—Lockwood, Dewey, Alex & Cummings

[57] ABSTRACT

A connector-terminal assembly for passing electrical current through a furnace firewall. A one piece insulator fits through a hole in the firewall and is braced to the firewall by a single retainer clip. A connector suitable for high temperature use is slideably mounted in a hole centrally through the insulator and retained therein by the electrical terminals on either end thereof. The insulator is mounted in the firewall independently of the connector mounting in the insulator, and vice versa. The insulator is mounted to the firewall free of compressive stress along the connector axis and the connector is mounted in the insulator free of tensile stress along its axis to allow for heat expansion of both components.

10 Claims, 8 Drawing Figures

CONNECTOR-TERMINAL ASSEMBLY FOR ELECTRICAL CONDUCTORS

BACKGROUND OF THE INVENTION

This invention relates to connector-terminal assemblies and more particularly to a specialized connector assembly adapted to pass electrical current through a furnace firewall and to operate under the extreme temperatures associated therewith.

There is a substantial need for electrical connectors which can function under the high temperatures commonly found in the furnace and heater art. The use of insulated connectors in electric furnaces and heaters, whether made for residential, commercial, or industrial uses, is widely known. However, the need also exists for the use of insulated connectors in furnaces fueled by other means.

Heretofore, connector-terminal assemblies suitable for installation through a furnace or heater firewall have included a two-piece insulator built around a threaded rod connector. Typically, a first piece of the insulation fits in a rectangular hole in the firewall and abuts one side of the wall adjacent the hole. The second piece of insulation fits over the portion of the first piece of insulation extending through the hole and abuts the opposing side of the wall adjacent the hole. Both pieces of insulation include a central hole therethrough in which the threaded rod is positioned. The threaded rod connector includes a square nut soldered thereon. The nut is nested in a rectangular cut-out portion in the first piece of insulation adjacent the outer end of the central hole for preventing the threaded rod from rotating therein. The threaded ends of the connector rod are utilized as terminals for conductors which may be fastened thereon. Typically, nuts and lock washers are fitted on the opposing ends. When tightened, one of the opposing nuts and the square nut maintain the entire assembly in mounted position on the firewall.

This prior art connector has several drawbacks. First, if a terminal on the connector is loosened to remove or replace a conductor, the entire assembly may become loose and unstable because the means for tightening at least one of the terminals is also the means for keeping the assembly mounted on the firewall. Second, when the opposed terminals are tightened, the two-piece insulator is positioned in compressive stress. As the furnace heats up, the insulator expands, and additional, potentially dangerous stress is built up in both the insulator pieces and the connector. The stress in the connector is tensile stress.

It is therefore a general object of the invention to provide an improved connector-terminal assembly constructed in accordance with the invention.

Another object of the invention is to provide a connector-terminal assembly for mounting through a furnace firewall hole utilizing a one-piece insulator which is free of compressive stress as mounted through the firewall.

Another object of the invention is to provide a connector assembly for furnace installation wherein the means for anchoring the insulator to a furnace firewall hole is structurally independent from the means for fastening conductors on the connector.

SUMMARY OF THE INVENTION

This invention is directed to a connector-terminal assembly for passing electrical current through a hole in a wall. The assembly includes an electrically conductive connector which is elongate in shape for extending through the firewall hole. The connector includes an electrical terminal positioned on each of the two opposing ends thereof. A single member insulator extends over a substantial portion of the length of the connector between the connector and the hole in the wall in which the assembly is mounted. A single member anchor means mounts the insulator to the wall.

The invention is further directed to an electrical connector assembly adapted for mounting through the hole in a firewall. The assembly includes a single insulator structure with a first portion having a cross section of like shape and smaller than the firewall hole for positioning through it. A second portion of insulator structure, which is adjacent to and integral with the first portion, has a cross section larger than the firewall hole for abutting the firewall when it is positioned adjacent to it. The insulator also includes a connector mounting hole extending through both the first and second portions. An elongate electrical connector is positioned in the connector mounting hole and includes opposed ends which extend outwardly of both respective insulator portions to define electrical terminals thereon. Each electrical terminal includes a fastener capable of retaining an electrical conductor thereon. The assembly further includes means for anchoring the insulator in mounted position through the firewall hole. The invention includes an improvement wherein the connector is free of tensile stress along its length and the insulator is free of compressive stress in a direction parallel to the axis of the connector mounting hole therein.

BRIEF DESCRIPTION OF THE DRAWINGS

The features of the present invention, which are believed to be novel, are set forth with particularity in the appended claims. This invention may best be understood by reference to the following description taken in conjunction with the accompanying sheets of drawings, in the several figures of which like reference numerals identify like elements, and in which:

DETAILED DESCRIPTION OF THE INVENTION

Figure 1:
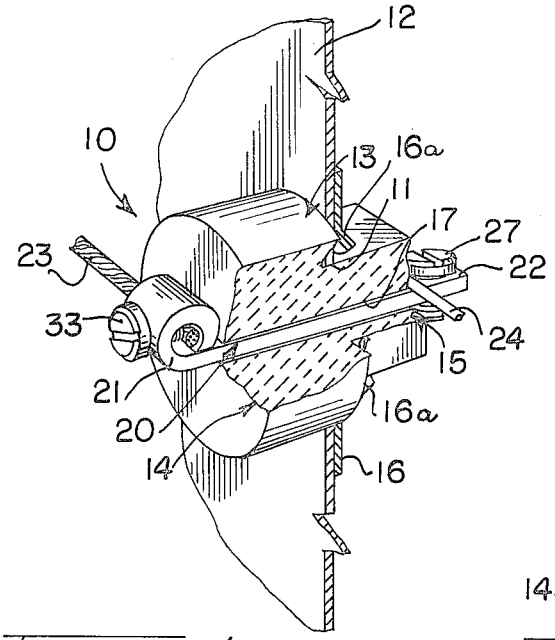
FIG. 1 is a perspective view, with portions cut away, of the connector assembly of the invention as mounted in a firewall.
Figure 2A:
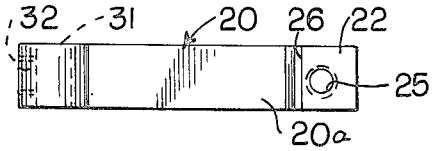
FIG. 2*a* is a plan view of the connector shown in FIG. 1.
Figure 2B:
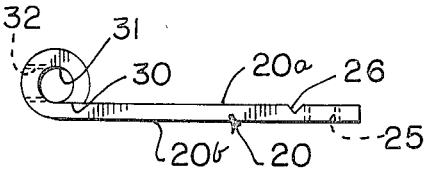
FIG. 2*b* is an elevational view of the connector of FIG. 2*a*.
Figure 3A:
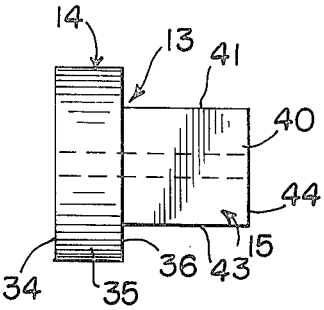
FIG. 3*a* is a side elevational view of the single piece insulator shown in FIG. 1.
Figure 3B:
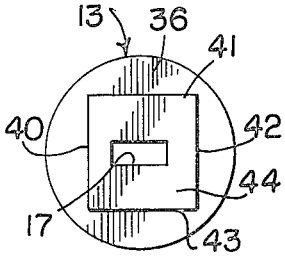
FIG. 3*b* is an end elevational view of the single piece insulator shown in FIG. 3*a*.
Figure 4:
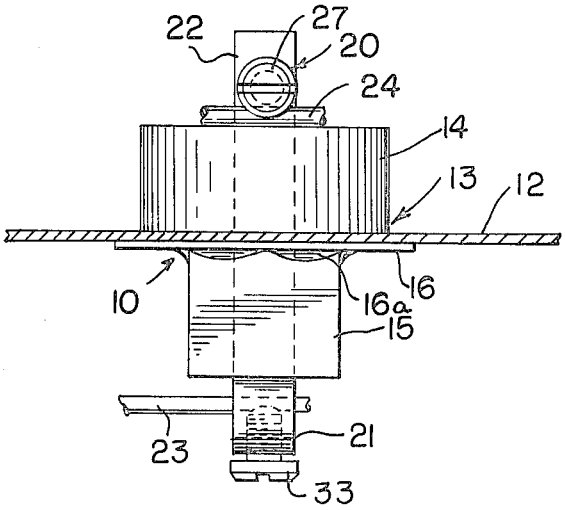
FIG. 4 is a top plan view of the connector assembly shown in FIG. 1.

Referring to FIGS. 1 and 4, the connector assembly 10 of the invention is shown mounted through a rectangular hole 11, in a firewall 12. Preferably, firewall 12 is made of sheet metal and defines an outer surface of a furnace (not shown) utilized for either residential, commercial, or industrial heating purposes.

Connector assembly 10 includes a one-piece insulator generally indicated at 13, made of dielectric material and having refractory capabilities. Insulator 13 includes a cylindrical portion 14 which has a larger diameter than the length of a diagonal line across square hole 11. Insulator 13 also includes a square shaped portion 15 which fits through square hole 11 when the insulator is mounted therein. A retainer 16 fits around the square portion 15 and maintains the insulator in snugly mounted position through hole 11 in a firewall 12. Insulator 13 further includes a rectangular hole 17 extending through both the cylindrical and square portions of the structure.

An electrical connector, generally indicated at 20, is mounted through the hole 17 in insulator 13. Connector 20 is preferably made of a nickel-chromium alloy having a high melting temperature. Connector 20 has electrical terminals 21, 22 positioned on the opposing ends thereof for mounting electrical conductors 23, 24 respectively therein. The conductor 20 is mounted in the insulator 13 completely independent of retainer 16 which mounts the insulator to the firewall 12. Therefore, electrical conductors 23, 24 may be removed from the connector without loosening the assembly from the firewall.

Referring to FIGS. *2a* and *2b*, connector 20 is a bar having a generally rectangular cross-section when taken perpendicular to its longitudinal axis. The height and width of rectangular bar 20 are sufficient to allow the bar to be slideably retained in the rectangular hole 17 through insulator 13. The length of connector bar 20 is sufficient to allow the terminal ends 21, 22 thereon to extend outwardly of the end surfaces of insulator 13 when the connector is mounted therethrough.

The central portion of connector bar 20 is positioned inside of the hole 17 and is a simple rectangular bar structure. One end of connector bar 20, which extends outwardly of the insulator as mounted therein, includes a terminal mounting 22 thereon, having a threaded hole 25 extending through the connector from the top side 20*a* to the bottom side 20*b* mediate the elongate side surfaces thereof. Spatially adjacent threaded hole 25 is a V-shape groove 26, which extends across the width of top surface 20*a* from one side surface of the connector 20 to the other side surface thereof. Groove 26 is of sufficient depth that electrical connector 24 may be positioned therein and yet extend above the top surface 20*a* thereof. A threaded screw 27 (FIGS. 1 and 4) screws into threaded hole 25 and the head of the screw restrainingly engages the conductor 24 in groove 26.

It should be noted that the threaded engagement of screw 27 in hole 25 prevents the connector 20 from being drawn out of hole 17. Also, since a screw 27 is mounted perpendicular to the longitudinal axis of the connector, there is no tensile stress across the length of the connector as assembled. Therefore, the connector 20 and insulator 13 may expand and contract at their own independent rates while the temperature on one side of firewall 12 differs substantially from the temperature on the opposing side of it. As a further advantage, the entire connector assembly 10 may be shipped in assembled condition with screw 27 mounted in threaded hole 25. It should be noted that screw 27 and groove 26 may be eliminated if the conductor is soldered, welded, or fastened in other like manner to terminal mounting 22.

At the opposing end of connector 20 is a rolled electrical terminal portion 21. The connector bar 20 is rolled in scroll fashion until the distal end 30 thereof contacts the upper surface 21*a* of the bar, thereby defining a hollow cylindrical portion 31 inside the rolled end of the connector bar into which a conductor 23 may be inserted. A second threaded hole 32 is positioned through the connector bar 20. Hole 32 forms a horizontal mounting extending inwardly from the outermost extending portion of the scroll, through the bar, and into communication with inner hollow portion 31. A second screw 33 is mounted in threaded hole 32 and, together with the scroll portion 21 of connector bar 20, they form a second conductor terminal. A conductor 23 may be positioned in the hollow cylindrical portion 31 and clamped therein by turning the screw 33 in threaded hole 32 until the distal end of the screw engages the conductor 23 and forces same against the portion of the hollow cylindrical surface 31 which is opposite the threaded hole 32. One advantage of the horizontal screw mounting on the scroll type terminal connector is the elimination of "knuckle busting" associated with fastening a screw positioned parallel to and in close proximity with a firewall. Further, the scroll inner wall 31 and the screw distal end clamp a conductor in an even pressure manner thereacross to provide a superior electrical contact between the conductor and the connector.

Referring to FIGS. *3a* and *3b*, the insulator 13 includes two integrally formed portions, a cylindrical portion 14 and a cubical or rectangular portion 15 integrally formed with the cylindrical portion. The cylindrical portion 14 includes a flat circular outer surface 34 defining one end of the insulator and one end of the rectangular hole 17 through the insulator in which the connector 20 is positioned. Cylindrical insulator portion 14 further includes an outer cylindrical surface 35 which is sufficiently large in size to provide an insulated bulkhead on one side of square hole 11 in the firewall 12, i.e., the diameter of cylindrical portion 14 is longer than a diagonal across the firewall hole 11. An inner flange surface 36 abuts the firewall 12 when the assembly is installed therein and forms an interface between cylindrical portion 14 and the rectangular block portion 15 of the insulator. The innermost edges of surface 36 define a square, with each edge integrally extending into one side of the cubical portion 15 of insulator 13 (see FIG. *3b*). Cubical portion 15 includes 4 square sides 40–43 and a square end surface 44 which forms the opposing end surface of the insulator. The width of sides 40–43 are identical and are sufficiently smaller than the length of each side in square firewall hole 11 to facilitate insertion therein. An opposing end of hole 17 is in communication with the central part of the outer square surface 44 of cubical portion 15. It can be appreciated that the cubical portion 15 could be of other similar shape within the scope of the invention. Further, the aim of cubical portion 15, besides having it fit through the firewall hole, is to be shaped so as to prevent the rotation of the insulator in the firewall hole.

A disk-shape retainer 16 is inserted over the cubical portion 15 after it is positioned through the firewall hole. The retainer is also positioned snugly against the side of firewall 12 opposite the cylindrical flange surface 36. Retainer 16 includes bent scalloped tabs 16*a*—16*a* (FIG. 1) which surround and define a hole through which the insulator cubical portion 15 is inserted. Tabs 16*a*—16*a* prevent the disk from sliding outwardly away from firewall 12 but allow it to slide inwardly toward the firewall 12. Once again, it should be noted that the retainer 16 utilized to mount the insulator 13 to the firewall 12 is installed and mounted completely independently of the connector 20. It can be understood that other suitable fasteners may be used to secure the insulator to the firewall within the scope of the invention.

Figure 6:
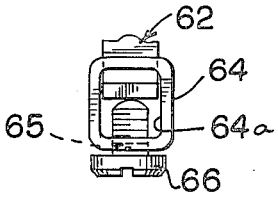
FIG. 6 is a top elevational view of the band type terminal portion of the assembly shown in FIG. 5.
Figure 5:
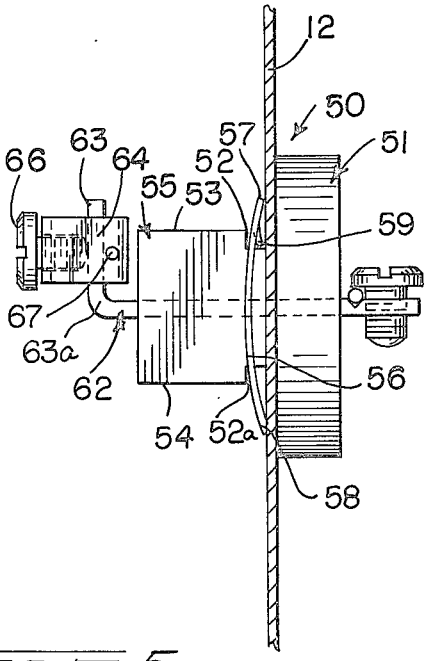
FIG. 5 is a side elevational view of the modification of the connector assembly of the invention.

Referring to FIGS. 5 and 6, a modified embodiment of the connector assembly of the invention is generally indicated at 50. The portions of the second embodiment 50 which do not differ from the like portions of the first embodiment will not be described in detail. The modified connector assembly 50 includes a single piece insulator 51 identical to insulator 13, with the exception of a pair of indented grooves 52—52 extending inwardly of opposing square side surfaces 53, 54 on the cubical portion 55 thereof. Grooves **52–52*a* are positioned immediately adjacent the innermost portions of the sides 53, 54, respectively, which contact the square hole 11 in firewall 12 when the insulator 50 functions as mountings for a U-shape bowed ring retainer 56 which maintains the insulator 51 in snugly mounted position aginst the firewall 12 in a manner similar, but not identical, to that of retainer 16 in the first embodiment. Whereas retainer 16 maintains insulator 13 mounted in firewall 12 by means of friction, bowed retainer 56 places positive pressure on the firewall 12 at its bight portion 57 as well as at its two distal end portions 58—58 (only one shown). Further, a bent tab 59 extending inwardly of the bight portion 57 positively engages one of the grooves 52—52 in insulator 51** and exerts positive pressure thereon to maintain the insulator in mounted position on the firewall.

The bar type connector 62 is identical to connector 20 of the first embodiment with the exception that the second terminal portion 63 at one end thereof is bent approximately 90° at elbow **63*a* rather than rolled as shown in the first embodiment. The distal terminal portion 63 further includes a circular band 64 having a hollow portion 64*a* therein of sufficient size to encircle at least a portion of the bent end on connector 62. Circular band 64 includes a threaded hole 65 positioned therethrough which provides a mounting for screw 66. As the screw 66 is turned in threaded hole 65, the side of circular band 64 which is opposite the threaded hole 65 is drawn into engagement with the side of terminal portion 63 opposite that side engaging the screw. A conductor (not shown) may be inserted in the space between the opposing side surfaces. As the screw 66 is turned in its mounting, the conductor is retained in the terminal mounting. The conductor may be inserted in the terminal through the upper open side of circular band 64, or may be inserted through an additional hole 67** positioned in the circular band.

While two particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

I claim:

1. In an electrical connector assembly adapted for mounting through a hole in a firewall, said assembly including:

a single insulator structure with a first portion thereof having a cross-section substantially of like shape and smaller than said firewall hole for positioning therethrough, and a second portion adjacent to and integral with said first portion having a cross-section larger than said firewall hole for abutting said firewall when positioned adjacent thereto; said insulator including a connector mounting hole extending through both first and second portions;

an elongate electrical connector positioned in said connector mounting hole and including opposed ends which extend outwardly of both respective insulator portions defining electrical terminals thereon, each electrical terminal including a fastener capable of retaining an electrical conductor thereon, said connector being free of tensile stress along the length thereof as mounted in said connector mounting hole; and means for anchoring said insulator in mounted position in said firewall hole;

the improvement wherein said anchor means is adapted to be secured on said insulator in spatial relation to said connector, and said insulator is free of compressive stress in a direction parallel to the axis of said connector hole therein.

2. The assembly defined in claim 1 wherein said connector includes a bar of rectangular cross-section having one flat end with a first hole perpendicularly therethrough, and a first fastener means positioned in said hole to define one of said electrical terminals, the opposing end of said connector includes a stop means for preventing said connector from moving completely through said connector mounting hole, and further including a hollow band extending around said opposing end of said connector, a threaded hole through said band in communication with the hollow portion thereof, and a screw positioned in said threaded hole to engage said connector and to fasten a conductor positioned between said connector and the portion of said band opposite said threaded hole therein.

3. The assembly defined in claim 1 wherein a cross-section of said first portion of said insulator is rectangular, a cross-section of said second portion of said insulator is circular, and a cross-section of said connector hole is rectangular when taken respectively through said insulator at positions parallel to the plane of the firewall as mounted thereon, the rectangular shapes in said insulator provide for securing said assembly to said firewall in a manner preventing the rotation of said insulator when mounted in said firewall hole and preventing the rotation of said connector when mounted in said insulator.

4. The assembly defined in claim 1 wherein said connector includes a bar of rectangular cross-section and includes one flat end having a first hole perpendicularly therethrough, and a first fastener means positioned in said hole to define one of said electrical terminals, the opposing end of said connector being curved around an axis perpendicular to the remainder of said connector to define a hollow area, a second hole positioned through said connector in communication with said hollow area, and a second fastener means positioned in said second hole to define the other of said electrical terminals.

5. The assembly defined in claim 4 wherein said second hole is threaded and said second fastener means includes a screw.

6. The assembly defined in claim 4 wherein said first and second holes are threaded and said first and second fastener means are screws.

7. In an electrical connector assembly adapted for mounting through a hole in a firewall, said assembly including:

a single insulator structure with a first portion thereof having a generally rectangular cross-section substantially of like shape and smaller than said firewall hole for positioning therethrough, and a second portion adjacent to and integrally formed with said first portion having a circular cross-section with a diameter thereof being of greater length than a diagonal across said firewall hole for abutting said firewall when positioned adjacent thereto, and a generally rectangular connector mounting hole extending through both said first and second portions, the rectangular shape of said insulator first portion providing for securing said assembly to said firewall in a manner preventing the rotation of said insulator when mounted in said firewall hole;

an elongate electrical connector including a bar of rectangular cross-section positioned in said connector mounting hole and including opposed ends which extend outwardly of both respective insulator portions, the rectangular cross-sectional shapes of said connector and said connector mounting holes preventing the rotation of said connector in said connector hole, said connector including one flat end having a first hole perpendicularly therethrough, and a first fastener means positioned in said hole to define a first electrical terminal, the opposing end of said connector to define a hollow area, a second hole positioned through said connector in communication with said hollow area, and a second fastener means positioned in said second hole to define a second electrical terminal, said connector as mounted in said mounting hole being free of tensile stress along the length thereof;

fastener means for anchoring said insulator in mounted position in said firewall hole;

an improvement wherein said fastener means is adapted to be positioned on said assembly in spatial relation to said connector, and said insulator is free of compressive stress in a direction parallel to the axis of said connector hole therein.

8. In an electrical connector assembly adapted for mounting through a hole in a firewall, said assembly including:

a single insulator structure with a first portion thereof having a cross-section substantially of like shape and smaller than said firewall hole for positioning therethrough, and a second portion adjacent to and integral with said first portion having a cross-section larger than said firewall hole for abutting said firewall when positioned adjacent thereto; said insulator including a connector mounting hole extending through both first and second portions;

an elongate electrical connector positioned in said connector mounting hole and including opposed ends which extend outwardly of both respective insulator portions defining electrical terminals thereon, each electrical terminal including a fastener capable of retaining an electrical conductor thereon; and means for anchoring said insulator in mounted position in said firewall hole;

the improvement wherein said anchoring means includes a disk-shape retainer including a hole centrally therethrough having bent portions positioned therearound for frictionally retaining said insulator in said firewall hole; and said connector is free of tensile stress along the length thereof, and said insulator is free of compressive stress in a direction parallel to the axis of said connector hole therein.

9. In an electrical connector assembly adapted for mounting through a hole in a firewall, said assembly including:

a single insulator structure with a first portion thereof having a cross-section substantially of like shape and smaller than said firewall hole for positioning therethrough, and a second portion adjacent to and integral with said first portion having a cross-section larger than said firewall hole for abutting said firewall when positioned adjacent thereto; said insulator including a connector mounting hole extending through both first and second portions;

an elongate electrical connector positioned in said connector mounting hole and including opposed ends which extend outwardly of both respective insulator portions defining electrical terminals thereon, each electrical terminal including a fastener capable of retaining an electrical conductor thereon; and means for anchoring said insulator in mounted position in said firewall hole;

the improvement wherein a cross-section of said first portion of said insulator is rectangular, a cross-section of said portion of said insulator is circular, and a cross-section of said connector hole is rectangular when taken respectively through said insulator at positions parallel to the plane of the firewall as mounted thereon, the rectangular shapes in said insulator provide for securing said assembly to said firewall in a manner preventing the rotation of said insulator when mounted in said firewall hole and preventing the rotation of said connector when mounted in said insulator;

said first insulator portion includes an indented slot thereon positioned spatially adjacent the juncture of said first and second insulator portions for receiving a portion of said anchoring means therein; and said connector is free of tensile stress along the length thereof, and said insulator is free of compressive stress in a direction parallel to the axis of said connector hole therein.

10. In an electrical connector assembly adapted from mounting through a hole in a firewall, said assembly including:

a single insulator structure with a first portion thereof having a cross-section substantially of like shape and smaller than said firewall hole for positioning therethrough, and a second portion adjacent to and integral with said first portion having a cross-section larger than said firewall hole for abutting said firewall when positioned adjacent thereto; said insulator including a connector mounting hole extending through both said first and second portions;

an elongate electrical connector positioned in said connector mounting hole and including opposed ends which extend outwardly of both respective insulator portions defining electrical terminals thereon, each electrical terminal including a fastener capable of retaining an electrical conductor thereon; and means for anchoring said insulator in mounted position in said firewall hole;

the improvement wherein said anchoring means includes a bowed U-shape clip for biasing said insulator against said firewall, and a portion of said bowed clip engaging said slot in said first insulator portion.

* * * * *

UNITED STATES PATENT AND TRADEMARK OFFICE

CERTIFICATE OF CORRECTION

PATENT NO. : 4,120,555

DATED : October 17, 1978

INVENTOR(S) : NED H. SHIFLETT, ET AL

It is certified that error appears in the above-identified patent and that said Letters Patent are hereby corrected as shown below:

--Column 4, Line 2--
"21a" should be "20a"

--Column 5, Line 21--
"aginst" should be "against"

Signed and Sealed this

*Sixth* Day of *February 1979*

[SEAL]

*Attest:*

RUTH C. MASON
*Attesting Officer*

DONALD W. BANNER
*Commissioner of Patents and Trademarks*